United States Patent [19]

Dunagan

[11] 4,268,619

[45] May 19, 1981

[54] ELECTROPLATING FROM A THIOSULFATE-CONTAINING MEDIUM WITHOUT SULFIDING

[75] Inventor: Kenneth M. Dunagan, Oklahoma City, Okla.

[73] Assignee: RKC Corporation, Oklahoma City, Okla.

[21] Appl. No.: 72,050

[22] Filed: Sep. 4, 1979

[51] Int. Cl.[3] ..... G03C 5/38; C25C 1/20

[52] U.S. Cl. ..... 430/398; 204/46 R; 204/109; 204/149

[58] Field of Search ..... 430/398; 204/109 R

[56] References Cited

U.S. PATENT DOCUMENTS

| | | | |
|---|---|---|---|
| 4,018,658 | 4/1977 | Alfin | 204/109 |
| 4,111,766 | 9/1978 | Idota | 204/109 |
| 4,166,781 | 9/1979 | Staples | 204/109 |

FOREIGN PATENT DOCUMENTS

| | | | |
|---|---|---|---|
| 817912 | 8/1959 | United Kingdom | 204/109 |

OTHER PUBLICATIONS

Mason, "Photographic Processing Chemistry," 1975, pp. 192–195.

Photo Lab Index, Quarterly Supp. No. 125, pp. 3-23-2-237, 1971.

*Primary Examiner*—Mary F. Downey

*Attorney, Agent, or Firm*—Berman, Aisenberg & Platt

[57] ABSTRACT

The useful life and stability of fixer used in the processing of film through developer, fixer and wash stages is significantly improved by withdrawing used fixer, electrolytically removing silver therefrom, stabilizing the withdrawn fixer by adjusting its pH to a substantially constant value and recirculating thus-treated used fixer for further film processing.

16 Claims, 3 Drawing Figures

ELECTROPLATING FROM A THIOSULFATE-CONTAINING MEDIUM WITHOUT SULFIDING

TECHNICAL FIELD

In the recovery of, e.g., silver dissolved in fixer solution during the processing of photographic, X-Ray or other films, sulfiding of the fixer solution is commonly encountered during electrolysis.

RELATED APPLICATION

A preferred embodiment of this application is related to the subject matter disclosed in U.S. application Ser. No. 917,112, filed June 19th, 1978 now U.S. Pat. No. 4,169,033. The entire disclosure and drawings of that application are incorporated herein by reference.

BACKGROUND ART

Fulweiler (U.S. Pat. No. 3,583,897) refers to the use of a rotating cylindrical cathode and indicates that it is desirable to keep the voltage as low as possible and to maintain a current density of from about 8 to 10 amperes per square foot of cathode surface. Cave (U.S. Pat. No. 3,925,184) recognized that the production of sulfide ions is a problem which must be controlled through control of plating current. DeSante (U.S. Pat. No. 3,183,177) considered the reversal of current in order to strip material from a plate on which it had been deposited. Duisenberg (U.S. Pat. No. 2,791,555) indicated that silver ions can be extracted from used photographic or "hypo" solutions via a plurality of disc-shaped cathodes which are negatively biased relative to a plurality of anode elements. Adams (U.S. Pat. No. 3,342,718) rotated the cathode and regulated the power supply. Tolle (U.S. Pat. No. 4,049,512) also suggested a motor-rotated cathode. Crellin (U.S. Pat. No. 3,642,594) recovered silver and regenerated used photographic fixing solutions electrochemically using high-current densities; he refers to electroplating silver from a used fixing solution containing 300 parts of hypo, 10 parts of "acedic acid", approximately 4 parts of silver and 1,000 parts of water.

Anderson (U.S. Pat. No. 3,715,299) recognized that continuous disturbance of the boundary layer surrounding the cathode structure significantly improves the electroplating process, while discouraging the formation of deleterious by-products. He indicates that his continuous circulation virtually eliminates any tendency towards sulfiding even with materailly-higher current densities. Geyken (U.S. Pat. No. 4,081,816) neutralizes excess quantities of developer by adding simple neutralizing agents, e.g., acetic acid, apparently to obtain chemical neutrality. Although Cooper (U.S. Pat. No. 3,663,416) employs a low voltage, it appears that he actually does obtain sulfiding.

Willier (U.S. Pat. No. 2,615,839) and Mandroian (U.S. Pat. No. 3,072,557) refer to voltages of from 1 to 1.2 volts. Snow (U.S. Pat. No. 3,477,926) refers to preventing the local drop in silver-ion concentration by agitation.

Lindau (U.S. Pat. No. 3,510,413) refers to treating the bath within a plating tank with about 6.4 ounces of glacial acetic acid. Graham (U.S. Pat. No. 3,577,334) prefers to operate at a constant voltage and indicates that the optimum is ordinarily in the range of from 0.5 to 1 volt.

Scheidegger (U.S. Pat. No. 4,139,431) refers to controlling pH, but does not disclose the specific voltage employed; he adds exhausted developer before or during electrolysis to control pH.

STATEMENT OF THE INVENTION

Sulfiding interferes with the electrolytic recovery of, e.g., silver from fixer solution used in film processing. Such sulfiding is eliminated at low voltages when the silver is deposited on a cathode which is not surrounded by a fluid barrier. To achieve this result, however, the current (in amperes) is maintained at least equal to, but not more than about twice, the corresponding voltage in volts and the pH of the medium from which the metal is removed is maintained at from about 4 to about 5.

In processing film through developer, fixer and wash stages, the effective useful life and stability of the fixer is significantly improved by withdrawing used fixer, removing silver therefrom (preferably by the previously-noted electrolytic process), adding to the withdrawn fixer about ¼ ounce of hardener per day per gallon of used fixer and recirculating thus-treated used fixer for further film processing.

DETAILED DESCRIPTION

Although the present invention is not in the structure of employed apparatus, drawings are included to illustrate (FIG. 1) how conventional apparatus may be readily modified to accommodate this invention.

Figure 1:
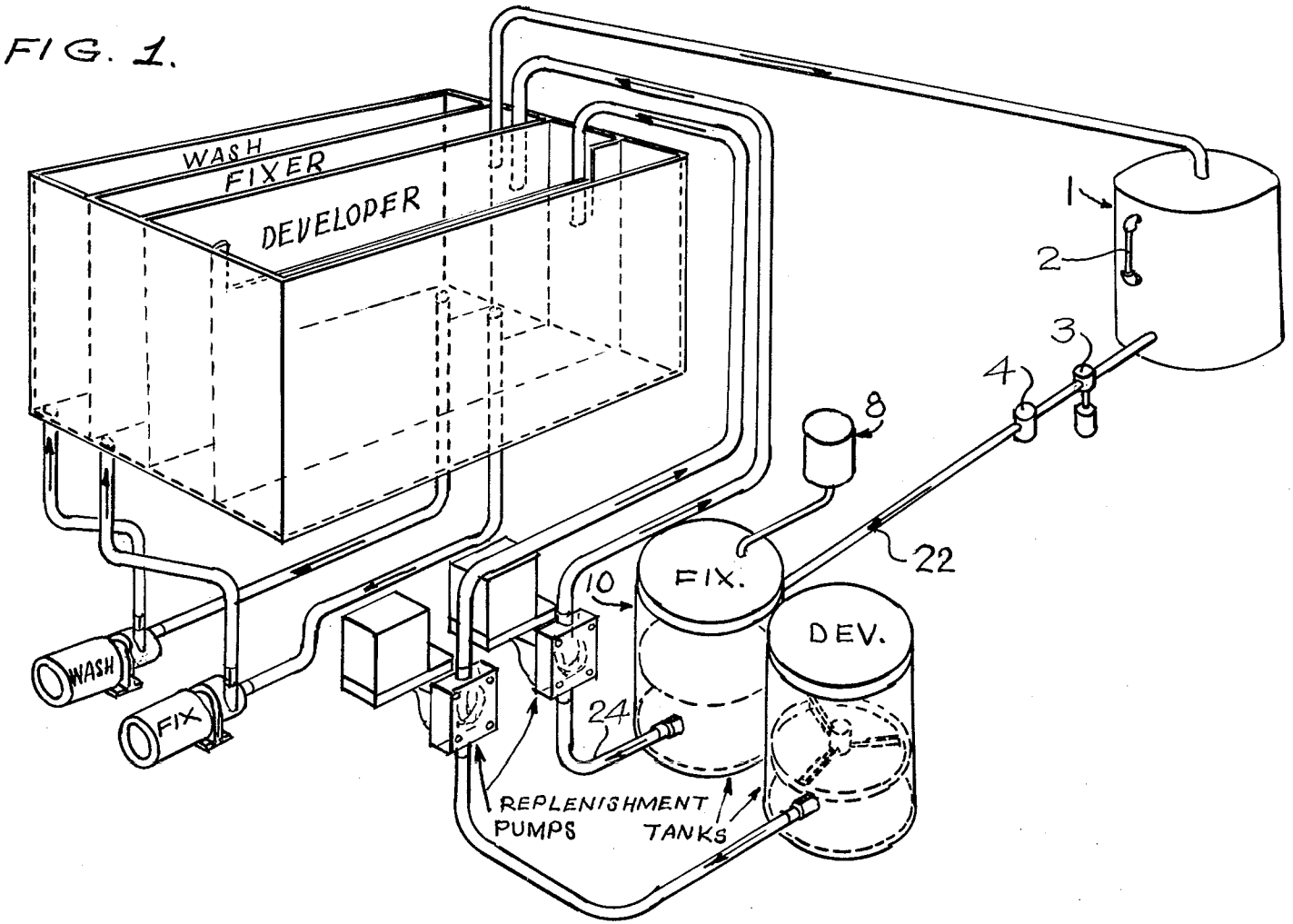
FIG. 1 is an isometric view of film-processing equipment with elements added for the practice of this invention.

FIG. 1 shows an overflow line from the fixer tank to an overflow-receiving tank 1 which has a float switch 2. This float switch is operatively connected to pump 3 (e.g. a chemical pump rated at 90 gallons per hour at a six-foot head) to pump used fixer through a filter (e.g. a two-micron filter for all fixer solution) via inlet conduit 22 to fixer-replenisher tank 10, from which replenished fixer is passed through outlet conduit 24 back into the fixer tank. Doser 8 is a hardener dispenser which introduces about 0.25 ounce (about 7.09 grams) per day per gallon of used fixer solution.

Figure 2:
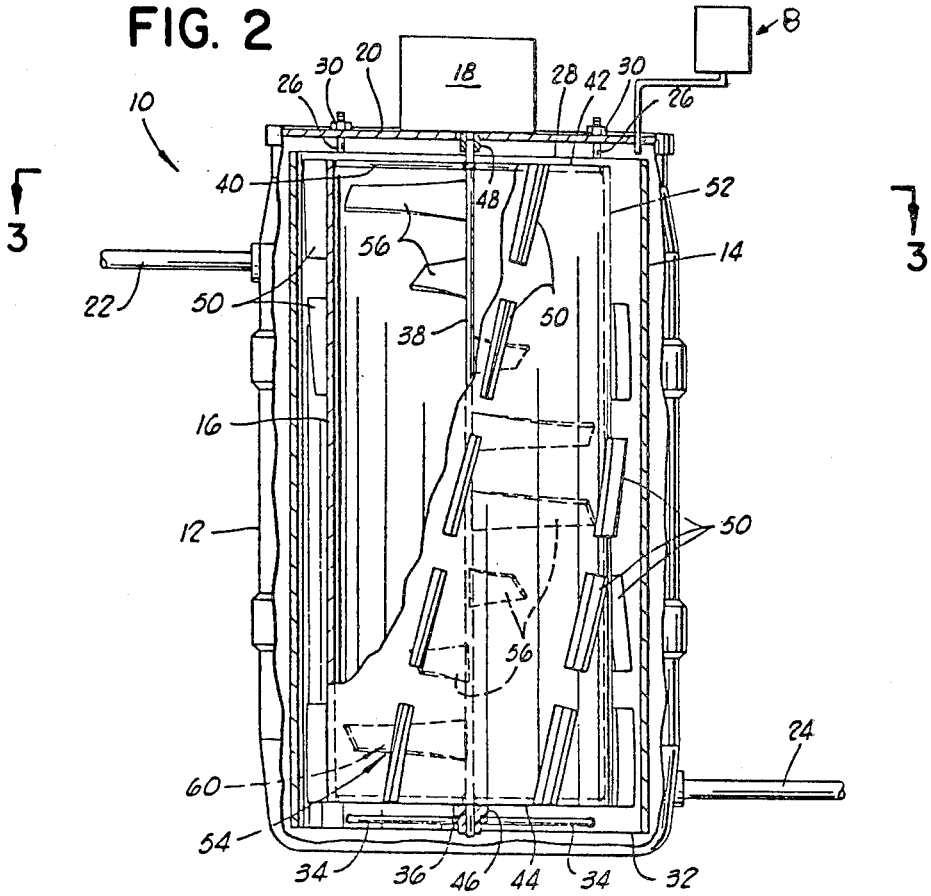
FIG. 2 is a partial-sectional, side elevational view of an electroplating cell constructed in accord with a preferred embodiment of the present invention.
Figure 3:
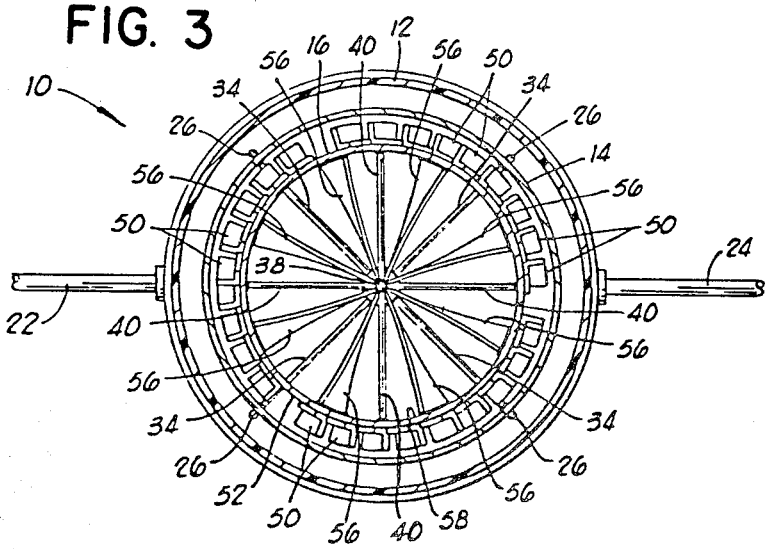
FIG. 3 is a cross-sectional view of the complete electroplating cell shown in FIG. 2 taken along line 3—3.

Details of fixer replenishment tank 10 are shown in FIGS. 2 and 3, which merely illustrate a preferred embodiment of apparatus in which the subject invention is employed. In such preferred apparatus replenishment tank 10 is an electroplating cell comprised primarily of a solution container 12, an anode 14, a cathode 16, and a control unit 18. The cell 10 is particularly well adapted for extracting silver ions from used photographic or "hypo" solutions. Dosing container 8 provides means for introducing from about 0.125 to about 0.375 ounce (3.7 to 11.1 cc) of hardener, e.g. acetic acid, per gallon (3.78 liters), per day of used "hypo" solution into fixer replenishment tank 10. This corresponds to from about 0.98 to 2.93 cc/liter/day or preferably about 1.95 cc/liter/day (0.25 ounce/gallon of used "hypo"/-day) which stabilizes the "hypo" and maintains its pH in the range of from 4 to 5.

The solution container 12 is preferably of cylindrical shape and formed of a chemically-inert plastic, with a plastic top 20 of conventional design. Solution containing the metal ions to be extracted by the cell 10 may be circulated through the solution container 12 via inlet and outlet conduits 22 and 24, respectively, in either a continuous or intermittent manner, as desired. Filtering apparatus 4 is integrated into the circulation path to extract gels and particulate material which could adversely affect the electroplating and recycling process.

The anode 14 is preferably of cylindrical shape and may be electrically and physically connected to the top 20 of the solution container 12 via a plurality of bolts 26 extending upwardly from an upper end 28 thereof through the top 20 into threaded engagement with associated nuts 30. Adjacent to a lower end 32 thereof, anode 14 is provided with a plurality of spokes 34 extending radially from a center hub 36 of generally annular shape. In the preferred form, anode 14 is manufactured from a chemically-stable metal material, such as stainless steel, although other suitable materials will readily occur to those skilled in the art.

The cathode 16 is preferably of cylindrical shape and of lesser diameter than anode 14. In this form, the cathode 16 may be provided with an axle 38 connected coaxially thereto via a plurality of spokes 40 extending radially between the axle 38 and the cathode 16 adjacent upper and lower ends 42 and 44 thereof. To improve rotary stability of the cathode 16, the axle 38 may be extended downwardly through a plastic bushing 46 disposed through the annular hub 36. Preferably, the cathode 16 is electrically and physically connected to the control unit 18 via the upper end of the axle 38 and a coupling 48 of conventional design. In the preferred form, the cathode 16 is manufactured from a chemically-stable metal material, such as stainless steel, although other suitable materials will readily occur to those skilled in the art.

The control unit 18 is preferably mounted on the top 20 of the solution container 12 and includes a motor (not shown) for rotating the cathode 16 at a pre-determined rate, e.g. 10 rpm, relative to the anode 14 via the coupling 48. This rate is sufficient to break the fluid barrier (surrounding the cathode) completely and without any aeration of the metal-ion-containing solution. Aeration is to be avoided.

In addition, the control unit 18 includes an electrical circuit of conventional design for electrically biasing the cathode 16 at a pre-determined negative voltage (from 0.1 to 2 and preferably from 1 or 1.1 to 1.3 or 1.5 volts) relative to the anode 14, preferably via the coupling 48 to the axle 38 and the bolts 26 extending through the plastic top 20.

As can be seen best in FIG. 2, a plurality of turbulence vane sections 50 of substantially helical shape are connected to cathode 16 on the outer surface 52 disposed adjacent to anode 14 at spaced intervals along the length of cathode 16. As shown in FIG. 3, each of the turbulence vane sections 50 has a portion thereof extending substantially radially from surface 52 generally toward anode 14. In the preferred form, longitudinally adjacent turbulence vane sections 50 are positioned in a helical pattern as generally indicated in FIG. 2 via the reference number 54. If desired, the turbulence vane sections 50 can be positioned in a plurality of helical patterns 54 at spaced intervals around the circumference of cathode 16. For convenience of manufacturing, it is preferred that the turbulence vane sections 50 be formed of the same material as cathode 16 and connected thereto in a conventional manner, such as welding.

A plurality of circulating vane sections 56 of substantially-helical shape may be connected, if desired, to cathode 16 on the inner surface 58 disposed opposite to the outer surface 52, which is disposed adjacent to anode 14 at spaced intervals along the length of cathode 16. As shown in FIG. 3, each of the circulating-vane sections 56 has a portion thereof extending radially from surface 58 generally toward axle 38. Preferably, each of the circulating vane sections 56 has a reverse curl relative to the turbulence vane sections 50, with longitudinally-adjacent circulating-vane sections 56 being positioned in a helical pattern as generally indicated in FIG. 2 via reference number 60. Although circulating-vane sections 56 have been shown in the drawings as forming a single helical pattern 60, additional circulating-vane sections 56 may be provided if desired to form a plurality of helical patterns 60. For convenience of manufacturing, it is preferred that the circulating-vane sections 56 be formed from the same material as cathode 16 and connected to extend between surface 58 and axle 38 in a convenient manner, such as welding.

OPERATION

Film (e.g. photographic, printing and X-Ray) is conventionally developed, fixed and washed in apparatus generally depicted in FIG. 1. To the conventional apparatus elements 1 to 4, 8 and 22 are added and element 10 is provided in the form of a specially designed electrolytic (metal-recovery) and fixer-stabilizing unit in a form such as that depicted by FIG. 2 and FIG. 3. Accordingly, an overflow line from the fixer tank conveys used fixer to a temporary storage tank 1, from which it is pumped by pump 3 through filter 4 to remove material which might adversely affect the electroplating process. From filter 4 the used fixer solution is conducted into electroplating cell 10.

Doser 8 introduces into the used fixer solution in container 10 sufficient hardener to stabilize the used fixer solution and to maintain its pH in the range of, e.g., from 4 (preferably 4.5) to 5. The stabilization and pH control are effected by adding about 0.25 ounce of hardener, e.g. acetic acid or any compatable hardner, per gallon of used fixer solution per day into the fixer solution contained in replenishment tank 10.

The solution container 12 (see FIG. 2) is filled through conduit 22 with used and filtered fixer solution, so that anode 14 and cathode 16 are substantially immersed in the solution. The anode and cathode are separated from each other by a fixed distance, which is any distance from, e.g., 1 inch (2.54 cm) to 12 inches (30.48 cm). The preferred distance between the anode and the cathode is from 3 inches (7.62 cm) to 6 inches (15.24 cm).

Upon actuation, the motor portion of the control unit 18 initiates rotation of cathode 16 at a desired predetermined rate (e.g. 10 revolutions per minute) relative to anode 14 via coupling 48 to the upper end of axle 38. The predetermined rate is any rate which, preferably, completely eliminates the fluid barrier surrounding the cathode without aerating the fixer solution. Cathode 16 is maintained substantially coaxial with anode 14 through the interface between the lower end of axle 38 and the annular hub 36 via bushing 46.

Substantially simultaneously, the electrical circuit portion of control unit 18 electrially biases cathode 16 at a desired predetermined negative voltage (from 0.1 to 2 volts) relative to anode 14 via electrical connections provided by coupling 48 and bolts 26. The induced potential difference between cathode 16 and anode 14 attracts silver ions in the used fixer solution toward cathode 16. Upon contacting cathode 16, the silver ions adhere to the surfaces of cathode 16 and form a solid plate of silver on cathode 16.

The current (in amperes) conducted through the used fixer solution is at least equal to and at most twice the voltage in volts. The voltage is preferably in excess of 0.1 volt, since silver does migrate to the cathode at a low rate (approximately 6 days) when such a low voltage is employed. As the voltage is ordinarily from 1 to 2 volts, the current is correspondingly from 1 to 4 amperes. The preferred voltage is from 1.1 to 1.2 volts; the corresponding current naturally varies with the resistance (depending on the distance between the anode and the cathode) and is, e.g., from about 1.25 to about 2.25 amperes for distances from 1 to 6 inches.

In general, the resulting decrease in the concentration of metal ions in the boundary layer of the solution adjacent surfaces of cathode 16 tends to retard plating action. Fluid dynamics principles are used to ensure direct exchange of the solution at lower concentration. Turbulence-vane sections 50 connected to cathode 16 at spaced locations on surface 52 induce circulation of the silver-ion solution in both the macro- and micro-systems. The turbulence-vane sections 50 are each of substantially helical shape and are preferably positioned to define helical patterns 54 so that, upon rotation of cathode 16, a general flow of silver-ion solution is encouraged between anode 14 and cathode 16. Simultaneously, the "gaps" or intervals between longitudinally-adjacent turbulent-vane sections 50 define abrupt discontinuities in the helical patterns 54, thereby producing turbulence "downstream" of the discontinuities which disturbs the boundary layer. The general circulation of the silver-ion solution is further enhanced by providing the circulating-vane sections 56 on the opposite surface 58 of cathode 16, with the reverse curl of the circulating vane sections 56 producing counterflow of the silver-ion solution relative to the direction of flow between cathode 16 and anode 14.

The rate of revolution of the cathode is usually at a fixed rate, but that rate can be, e.g., a rate in the order of from 4 to 10 revolutions per minute relative to anode 14.

The generally-turbulent circulation of the silver-ion solution across the surfaces of cathode 16 produced by the turbulence-vane sections 50, as enhanced by the circulating-vane sections 56, significantly improves the efficiency of the electroplating cell 10, while minimizing the possibility of undesirable side effects.

In addition to breaking the fluid barrier which surrounds the cathode, the present invention is directed to some very definite operating parameters. It permits the use of very low voltages in the electrolytic removal of silver from used fixer solution. At voltages as low as 0.1 volt, silver actually migrates to the cathode at a low rate; it takes approximately six days. In excess of 0.1 volt, however, such migration is virtually precluded. It is advantageous to operate at a voltage from 1 to 2 volts and preferably from 1.1 or 1.2 to 1.3 or 1.5 volts. The current (measured in amperes) is at least equal to and at most twice the voltage in volts and depends somewhat upon the distance between the anode and the cathode, which may be anywhere from 1 to 12 inches. A distance of from 3 to 6 inches is preferred.

Hardener, e.g. acetic acid or any compatible hardener, is added to the used fixer solution in order to stabilize it; such addition maintains the pH of the used fixer solution at a pH of from 4 to 5, preferably from 4.5 to 5. The amount of hardener added to the used fixer solution is from 0.125 to 0.375 ounce per gallon of used fixer solution per day.

Operating under these parameters results in significantly reduced cost. The use of a closed electrolytic unit results in capturing from 10 to 20 percent more silver. Silver is removed from the anode in conventional manner by reversing the current.

As previously stated, the distance between the anode and the cathode is not critical. Such distance is, e.g., anywhere from one inch, two inches, three inches or four inches through twelve inches. In a 55-gallon test unit the spacing was one inch between the anode and cathode; the voltage was held at 1.1 volt with an amperage of 2.25 amps. Another test was conducted with the anode 3 inches from the cathode; a voltage of 1.1 volt and an amperage of 1.75 amp. As the spacing between the anode and cathode increases, the resistance increases; the amperage thus decreases when the voltage is maintained constant. With a voltage of from 1.1 to 1.2 volt a distance of from 3 to 6 inches between the anode and cathode is preferred. When the anode and cathode are 6 inches apart and the voltage is 1.1 volt, the amperage is approximately 1.25 amp.

With a cathode designed to break the fluid barrier completely, a very low voltage (up to 1.5 volt D.C.) is required to recover silver at a very rapid rate approximately 8 hours). Since the silver is pure, it does not migrate back into solution even when the unit is turned off for 48 hours. Previously-known units slough off silver if turned off for such a period of time.

Although used fixer solution can be reused, such would last only for two or three days in the absence of adding hardener to the used fixer solution. Hardener is part of the fixer solution and is depleted during the finishing of negative or positive film. The amount of hardener which must be introduced is critical. The optimum is 0.25 ounce per gallon of fixer that has been used; and this amount can be varied no more than 0.125 ounce in either direction. When less than 0.25 ounce of hardener (per gallon per day) are added, the produced negatives are soft after several uses and the film is ruined; when more than 0.25 ounce (per gallon per day) of hardener are added, the film becomes too brittle after several uses and the film is also ruined. The pH of the fixer solution is maintained at from 4.5 to 5 virtually indefinitely when 0.25 ounce of hardener (per gallon per day) is added back into the used fixer solution.

INDUSTRIAL EXPLOITATION

The present invention is readily incorporated into recognized industrial processes. By using the instantly-taught parameters, the operation costs are reduced, sulfiding is prevented and from 10 to 20 percent more silver is recovered. The process is readily applied to development of film in, e.g., printing, photographic and X-Ray film development.

The invention and its advantages are readily understood from the preceding description. It is apparent that various changes may be made in the process without departing from the spirit and scope of the invention or sacrificing its material advantages. The hereinbefore described process is merely illustrative of preferred embodiments of the invention.

What is claimed is:

1. In a method for electroplating a negatively-charged surface by removing metal ions from a thiosulfate-containing medium in contact with the negatively-charged surface and wherein said negatively-charged surface is not completely surrounded by a fluid barrier during electroplating, the improvement which comprises:

(a) maintaining a voltage of from 0.1 to 2 volts across the medium, (b) maintaining through the medium a current in amperes which is at least equal to, but not more than about twice, the corresponding voltage in volts, (c) maintaining the pH of the medium at a pH of from about 4 to about 5 and (d) agitating the medium without aerating it.

2. A method according to claim 1 wherein the medium is fixer solution used in processing negative and/or positive film.

3. A method according to claim 2 which comprises adding from about 0.125 to about 0.375 ounce of hardener per day per gallon of fixer solution.

4. A method according to claim 2 which comprises adding about 0.25 ounce of hardener per day per gallon of fixer solution.

5. A method according to claim 4 wherein the hardener is acetic acid.

6. A method according to claim 4 wherein the pH is maintained within the approximate range of from 4.5 to 5.

7. A method according to claim 1 wherein the maximum voltage is in the range of from 1.3 to 1.5 volts.

8. A method according to claim 1 wherein the maximum voltage is 1.3 volts.

9. A method according to claim 1 wherein the voltage is in excess of 0.1 volt.

10. A method according to claim 1 wherein the voltage is from 1 to 2 volts.

11. A method according to claim 1 wherein the voltage is from about 1.1 to about 1.2 volts.

12. A method according to claim 1 wherein the current flows through the medium from an anode to a cathode which are separated by a distance of from 1 to 12 inches.

13. A method according to claim 11 wherein the distance is from 3 to 6 inches.

14. In a film developing process which comprises passing exposed film through developer, fixer and a wash, the improvement which comprises:

(a) withdrawing used fixer, (b) removing silver from the withdrawn used fixer in accord with the method of claim 1, (c) adding to the withdrawn fixer from about 0.125 to about 0.375 ounce of hardener per day per gallon of used fixer, and (d) recirculating thus-treated used fixer for further film processing, whereby the useful life and stability of the fixer are significantly extended.

15. A process according to claim 14 wherein step (c) comprises adding to the withdrawn fixer about 0.25 ounce of hardener per day per gallon of used fixer.

16. A process according to claim 15 wherein the hardener is acetic acid.

* * * * *